US007567160B2

(12) United States Patent
Folts et al.

(10) Patent No.: US 7,567,160 B2
(45) Date of Patent: Jul. 28, 2009

(54) SUPPLEMENTARY TRANSFORMER COOLING IN A REACTIVE POWER COMPENSATION SYSTEM

(75) Inventors: Douglas C. Folts, Baraboo, WI (US); Gary J. Bowers, Waunakee, WI (US)

(73) Assignee: American Superconductor Corporation, Westborough, MA (US)

( * ) Notice: Subject to any disclaimer, the term of this patent is extended or adjusted under 35 U.S.C. 154(b) by 607 days.

(21) Appl. No.: 11/354,562

(22) Filed: Feb. 15, 2006

(65) Prior Publication Data

US 2007/0188282 A1 Aug. 16, 2007

(51) Int. Cl.
*H01F 27/08* (2006.01)

(52) U.S. Cl. ..... 336/55

(58) Field of Classification Search ..... 336/55–62; 361/688–703; 219/756–757
See application file for complete search history.

(56) References Cited

U.S. PATENT DOCUMENTS

| | | | | |
|---|---|---|---|---|
| 4,539,469 | A * | 9/1985 | Gigandet | 219/412 |
| 4,623,771 | A | 11/1986 | Sakino | |
| 6,392,856 | B1 | 5/2002 | Kehrli et al. | |
| 6,621,057 | B2 | 9/2003 | Kim | |
| 6,906,434 | B1 | 6/2005 | Koeppe et al. | |
| 6,987,331 | B2 | 1/2006 | Koeppe et al. | |
| 2005/0194944 | A1 | 9/2005 | Folts et al. | |
| 2006/0087812 | A1 | 4/2006 | Meyer | |
| 2006/0171115 | A1* | 8/2006 | Cramer | 361/695 |
| 2007/0215329 | A1* | 9/2007 | Schwab | 165/122 |
| 2007/0247811 | A1* | 10/2007 | Ohmi | 361/697 |
| 2007/0279863 | A1* | 12/2007 | Illerhaus | 361/695 |

OTHER PUBLICATIONS

Dynamic Reactive Power Compensation Utilizing State of the Art Power Electronics Technology, D-VAR Datasheet, American Superconductor Corporation, 2004, 2 pages.

Larsen, Chris, "Dynamic VAR Compensation for Wind Interconnection", Apr. 12, 2005, 6 pages, UWIG Annual Meeting.

Roberts, Brad, "It's VARY-Y Important Understand VAR Compensation In a Power System," Energy User News, Sep. 2004, 4 pages, vol. 28, No. 9.

(Continued)

*Primary Examiner*—Tuyen Nguyen
(74) *Attorney, Agent, or Firm*—Daly, Crowley, Mofford & Durkee, LLP

(57) ABSTRACT

A reactive power compensation system includes a reactive power compensation device and a transformer electrically connected to the reactive power compensation device and having a cooling unit. The reactive power compensation device has an enclosure housing power electronics and at least one fan which provides an airflow for cooling the power electronics. The enclosure further includes an air outlet through which the airflow exits the enclosure after cooling the power electronics. The air outlet and the airflow are directed toward the cooling unit of the transformer to provide supplementary cooling to the transformer. The transformer cooling unit comprises external cooling fins in a liquid-filled transformer embodiment and comprises an air inlet of the transformer housing in a dry-type transformer embodiment. An optional duct may be provided between the enclosure and the transformer cooling unit.

21 Claims, 13 Drawing Sheets

OTHER PUBLICATIONS

Unit Substation, Small Power Transformers, ABB Inc., 12 pages, Descriptive Bulletin 47-450 Revised Jan. 2002.
Substation Transformers, Primary or Secondary Unit, Electrical Apparatus 210-15, Cooper Power Systems, Mar. 1998, 8 pages.
Substation Transformers, Substation Transformer Installation, Operation and Maintenance Instructions and Parts Replacement Information, Service Information S210-15-10, Cooper Power Systems, Sep. 1999, 16 pages.

* cited by examiner

SUPPLEMENTARY TRANSFORMER COOLING IN A REACTIVE POWER COMPENSATION SYSTEM

CROSS REFERENCE TO RELATED APPLICATIONS

Not Applicable.

STATEMENT REGARDING FEDERALLY SPONSORED RESEARCH

Not Applicable.

FIELD OF THE INVENTION

This invention relates generally to cooling for a reactive power compensation system and, more particularly, to cooling the transformer of a reactive power compensation system.

BACKGROUND OF THE INVENTION

To remain competitive, electrical utility companies continually strive to improve system operation and reliability while reducing costs. To meet these challenges, the utility companies are developing techniques for increasing the life of installed equipment, as well as diagnosing and monitoring their utility networks. Developing these techniques is becoming increasingly important as the size and demands made on the utility power grid continue to increase. A utility power grid is generally considered to include both transmission line and distribution line networks for carrying voltages greater than and less than about 25 kV, respectively.

Voltage instability on the utility power grid is a critical problem for the utility industry. In particular, when a fault occurs on the transmission grid, momentary voltage depressions are experienced, which may result in voltage collapse or voltage instability on the grid.

Various equipment and device solutions have been developed to address voltage instability problems. The term "Flexible AC Transmission Systems" (FACTS) is used to describe technologies to enhance the capacity and stability of power transmission systems. These systems operate by temporarily injecting power into the system.

One FACTS technology is dynamic shunt compensation in which a dynamic shunt compensator connected in parallel with the power system automatically and instantaneously adjusts its reactive power output by injecting real and/or reactive power into the system in response to line voltage disturbances. A dynamic shunt compensator may be referred to more generally as a type of reactive power compensation system. FACTS devices may also be series-connected to the power system.

Reactive volt-amperes are expressed in VARs; a term coined from the first letters of the words "volt amperes reactive." Reactive volt-amperes considered over a period of time represent oscillations of energy between the source and the load. Transmission systems require reactive power as part of their fundamental operation. The reactive power sets up magnetic fields in the transmission cables and transformers that allow "real" power to flow. Generating or absorbing reactive power at a given point on a transmission system is the primary means of regulating the voltage at that point. In particular, if it is determined that a line voltage is too high, then an inductive current is injected into the line (i.e., reactive power absorption) to lower the line voltage; whereas, if the line voltage is too low, then a capacitive current is injected (i.e., reactive power generation) to raise the line voltage.

One type of dynamic shunt compensator, called a Static VAR Compensator (SVC), generates reactive power from a bank or switched banks of capacitors. A thyristor-switched inductor is connected in parallel with the capacitors to partially or fully absorb the VARs generated by the capacitors. As the conduction phase angle of the thyristor switch is varied from full on to off, lesser amounts of VARs will be absorbed and the SVC's net VAR output becomes variable and hence capable of adjusting the voltage on the network. The SVC continuously shifts the phase angle (VAR output) in response to dynamic power swings on the transmission network due to changing system conditions.

Another type of dynamic shunt compensator, called a Static Synchronous Compensator (STATCOM), uses power electronics (e.g., a voltage sourced inverter) to generate the VARs. Like an SVC, a STATCOM generally includes one or more step-up transformers to convert the reactive power to the appropriate voltage level for coupling to the transmission system. The power electronics generally includes an inverter whose output current phase is controlled to lead the output voltage by 90 electrical degrees when generating (capacitive) VARs or to lag the voltage by 90 degrees when absorbing (inductive) VARs.

An example of a STATCOM system is the D-VAR® system manufactured by American Superconductor Corporation of Westboro, Mass. described in U.S. Pat. No. 6,987,331 entitled Voltage Recovery Device for use with a Utility Power Network. The D-VAR® system can be configured to provide up to hundreds of megaVARs (MVARs) of reactive compensation. The amount of reactive power delivered per unit is typically on the order of 1 to 8 MVARs continuous, with an instantaneous reactive power output up to approximately 24 MVARs per unit. A modular version of the D-VAR® system is comprised of modular units generally referred to as power electronics enclosures, such as the PowerModule™ enclosure (PME) manufactured by American Superconductor Corporation of Westboro, Mass. The PME resembles metal enclosured switchgear with approximate dimensions of 8 feet by 8 feet by 8 feet.

Various configurations of reactive power compensation systems are possible. For example, a Dynamic VAR Compensator (DVC™) system manufactured by American Superconductor Corporation of Westboro, Mass. is a configuration that employs switched capacitors and/or inductors in combination with a D-VAR® system, to augment the overall reactive power rating. The DVC™ system is described in published U.S. patent application Ser. No. 10/794,398.

Another reactive power compensation system configuration uses a series impedance upstream of the D-VAR® system and is capable of restoring voltage sags on the transmission system to within acceptable limits at a load. Such systems are used in applications where a substation feeds a dedicated load at which power quality is paramount (e.g. semiconductor fabrication facility). An example of such a system is the Power Quality-Industrial Voltage Restorer (PQ-IVR™) system manufactured by American Superconductor Corporation of Westboro, Mass. and described in U.S. Pat. No. 6,392,856 entitled Method and System for Providing Voltage Support to a Load Connected to a Utility Power Network.

Still another type of reactive power compensation system configuration is a Distributed Superconducting Magnetic Energy (D-SMES) storage system, which refers to a STATCOM having energy storage capability. One such system is described in a U.S. Pat. No. 6,906,434 entitled Electric Utility System with Superconducting Magnetic Energy Storage.

Traditional STATCOMs have large, fixed ratings on the order of 25 MVA to 100 MVA and are customized for each customer/application. Also, per the ANSI standard, utility substation transformers designed for natural convection cooling are rated for 30° C. average ambient temperature over any twenty-four hour period and 40° C. maximum. These factors make it difficult to provide modular, scaleable reactive power compensation systems based on standard "building blocks," such as standard transformers. For example, it is not efficient to use the same transformer for D-VAR® systems installed in climates warmer than the ANSI standard, since such installations would require a higher rated transformer or one that is fan cooled, whereas no such requirement is necessary in cooler climates.

One way to provide a "standard" transformer solution with an ANSI standard transformer is to use supplemental fan cooling for the transformer in warmer climates. Alternatively or additionally, in such warmer climates, the ANSI standard transformer may be operated at less than its full power specifications (i.e., derated). However, both of these approaches add cost.

SUMMARY OF THE INVENTION

According to the invention, a reactive power compensation system coupled to a utility network to provide reactive power includes a reactive power compensation device having an enclosure housing power electronics and at least one fan which provides an airflow for cooling the power electronics. The enclosure has an air outlet through which the airflow exits the enclosure after providing cooling to the power electronics. The reactive power compensation system further includes a transformer electrically connected to the reactive power compensation device and having a cooling unit. The air outlet and airflow from the reactive power compensation device are directed toward the cooling unit of the transformer to provide supplementary cooling to the transformer.

With this arrangement, supplementary cooling is provided to the transformer at no additional cost, since the supplementary cooling is provided by fans required to cool the power electronics. The supplementary cooling advantageously permits the power electronics enclosure to be positioned in close proximity to the transformer without requiring the use of a higher temperature rated transformer, operation at less than full transformer power specifications (i.e., derating the transformer), or additional fans.

In one embodiment, the transformer is a liquid-filled transformer and the cooling unit of the transformer includes external cooling fins. In this embodiment, the airflow from the reactive power compensation device is directed over the external cooling fins of the transformer.

Also described is a dry-type transformer embodiment in which the transformer is forced-air cooled. In this embodiment, the airflow from the reactive power compensation device is directed to the air inlet of the transformer housing for providing direct, convection cooling to the transformer windings.

Also described is an optional duct between the air outlet of the enclosure and the transformer cooling unit in order to facilitate directing the airflow to the cooling unit by preventing the airflow from dispersing. In the liquid-filled transformer embodiment in which the transformer cooling unit includes external cooling fins, a duct extension may be provided adjacent to a portion of the cooling fins, so that a portion of the fins remains exposed to allow for natural convection cooling. The duct provides the additional advantage of reducing the ambient noise level from the fan.

BRIEF DESCRIPTION OF THE DRAWINGS

The foregoing features of the invention, as well as the invention itself may be more fully understood from the following detailed description of the drawings, in which.

DETAILED DESCRIPTION OF THE INVENTION

Figure 1:
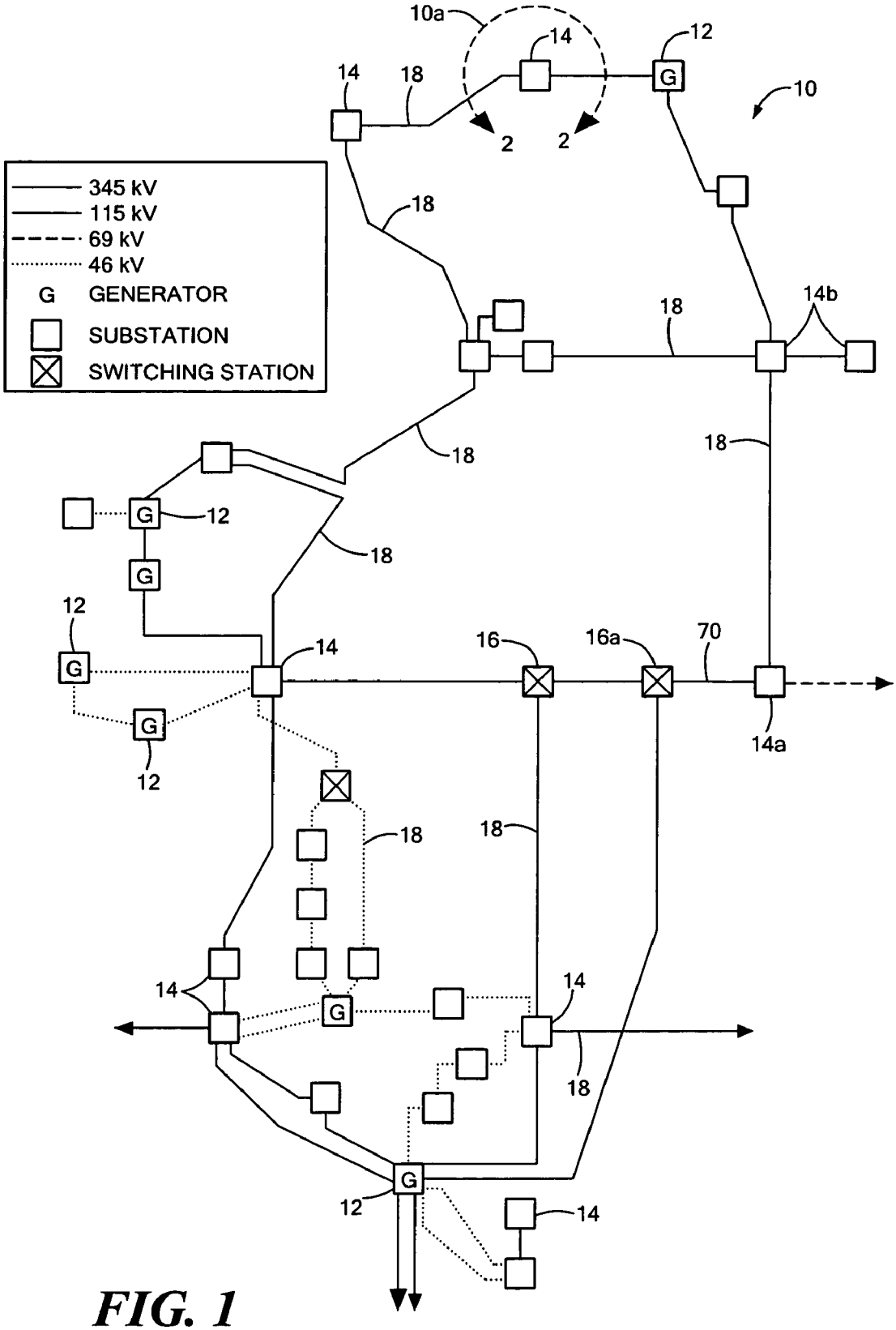
FIG. 1 is a diagrammatic representation of a utility power system including a plurality of reactive power compensation systems according to the invention.

Referring to FIG. 1, a portion of a utility power network includes a transmission network 10 having generators 12, substations 14, and switching stations 16, all of which are interconnected via transmission lines 18. Transmission lines 18, in general, carry voltages in excess of 25 kilovolts (kV). With reference to FIG. 1, the transmission system voltages are indicated in the accompanying key located at the lower right.

Figure 2:
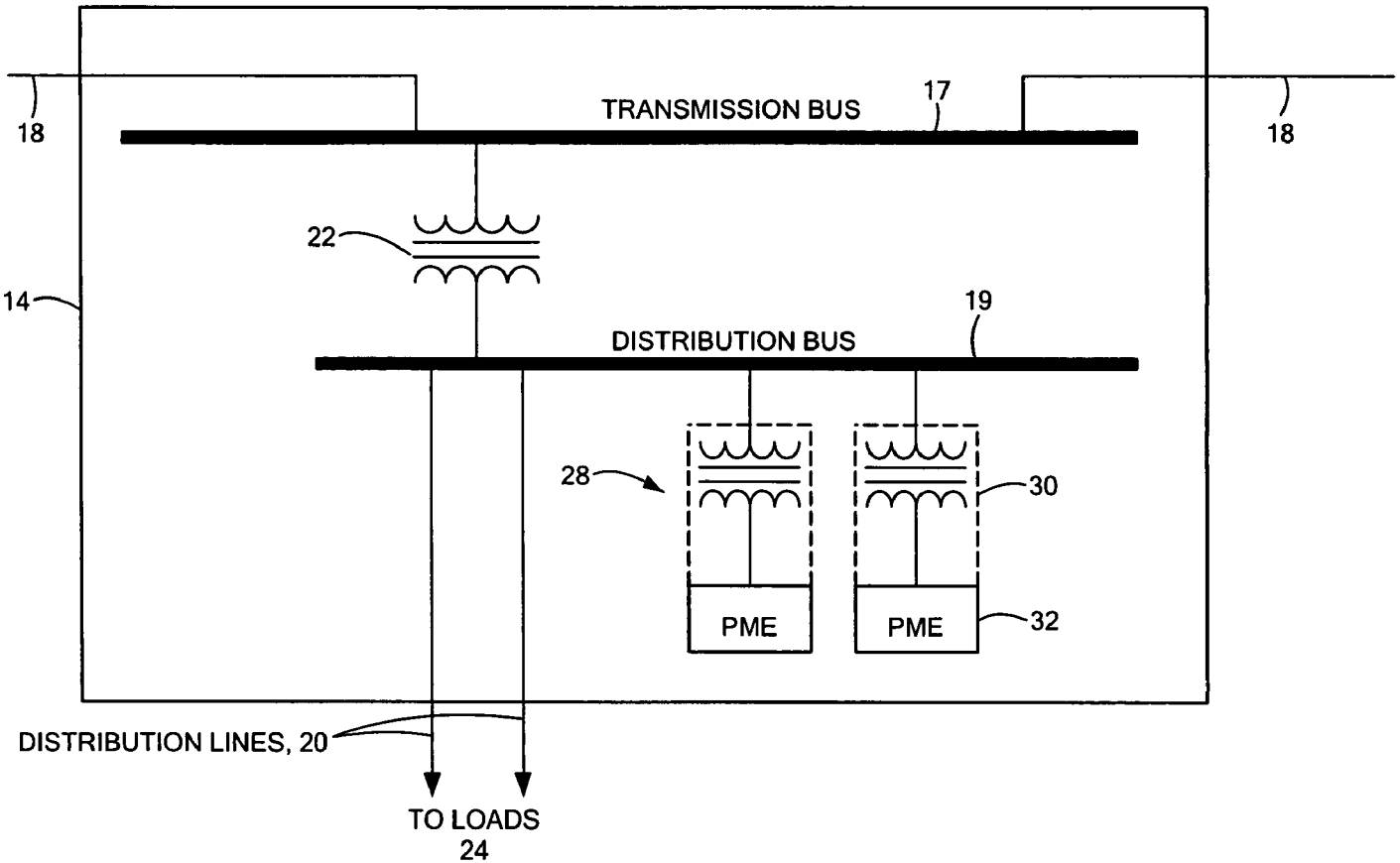
FIG. 2 is an enlarged section of a portion of the utility power system of FIG. 1 taken along line 2-2 of FIG. 1 and including reactive power compensation systems according to the invention.

Referring to FIG. 2, an exploded portion 10*a* of the utility power network of FIG. 1, includes transmission lines 18 connected through circuit breakers (not shown) to a transmission bus 17 within the substation 14. A step-down transformer 22 connects the transmission bus 17 to a distribution bus 19 which is further connected to distribution lines 20 that carry power to loads 24 at voltage levels less than those levels associated with transmission lines 18 (e.g., 25 kV or less).

Reactive power compensation systems 28 are coupled to the distribution bus 19 for the purpose of injecting reactive power into or absorbing reactive power from the line to maintain the voltage at the respective transmission or distribution bus at a desired level, within a specified tolerance. As discussed above, various types of reactive power compensation systems are available, such as the D-VAR® system manufactured by American Superconductor Corporation of Westboro, Mass. Reactive power compensation systems 28 are useful throughout the utility transmission and distribution network and for large industrial customers serviced by a dedicated substation. Reactive power compensation systems typically regulate voltage to within prescribed limits in the presence of dynamic power grid changes such as fault clearing or abrupt load changes. They also mitigate the effects of voltage collapse, first swing stability, and other dynamic power grid changes. Such systems are particularly desirable for use at loads with high sensitivity to voltage disturbances (e.g., semiconductor manufacturing facilities) and in portions of transmission and distribution systems needing VAR support. In addition, they can be used to allow wind farms to meet transmission grid interconnection requirements by providing a source of reactive power to ensure a more regulated voltage input when the wind farm is connected to the grid and to allow wind farms to meet low-voltage ride through requirements.

Each reactive power compensation system 28 includes a transformer 30 and a reactive power compensation device 32, both of which will be described further below. In general, the reactive power compensation device 32 includes an enclosure housing power electronics. One illustrative reactive power compensation device 32 is a PowerModule™ enclosure (PME) manufactured by American Superconductor Corporation of Westboro, Mass.

The transformer 30 is a step-up transformer that converts the reactive power to the appropriate voltage level for coupling to the distribution bus 19 and may take various forms, depending on the particular system requirements. One illustrative transformer is of the type provided by Cooper Power Systems, Inc. of Waukesha, Wis. from Electrical Apparatus Bulletin 210-15 which is a primary or secondary unit substation transformer having a nominal three-phase power rating of 4 MVA.

Figure 3:
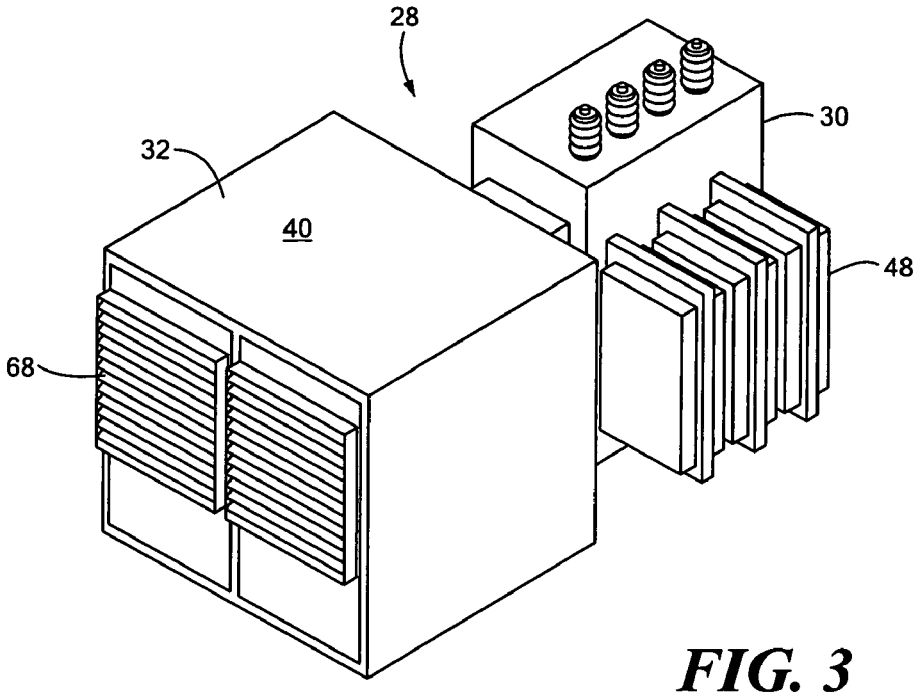
FIG. 3 is a perspective view of an illustrative reactive power compensation system of FIGS. 1 and 2, including a reactive power compensation device and a transformer according to the invention.
Figure 4:
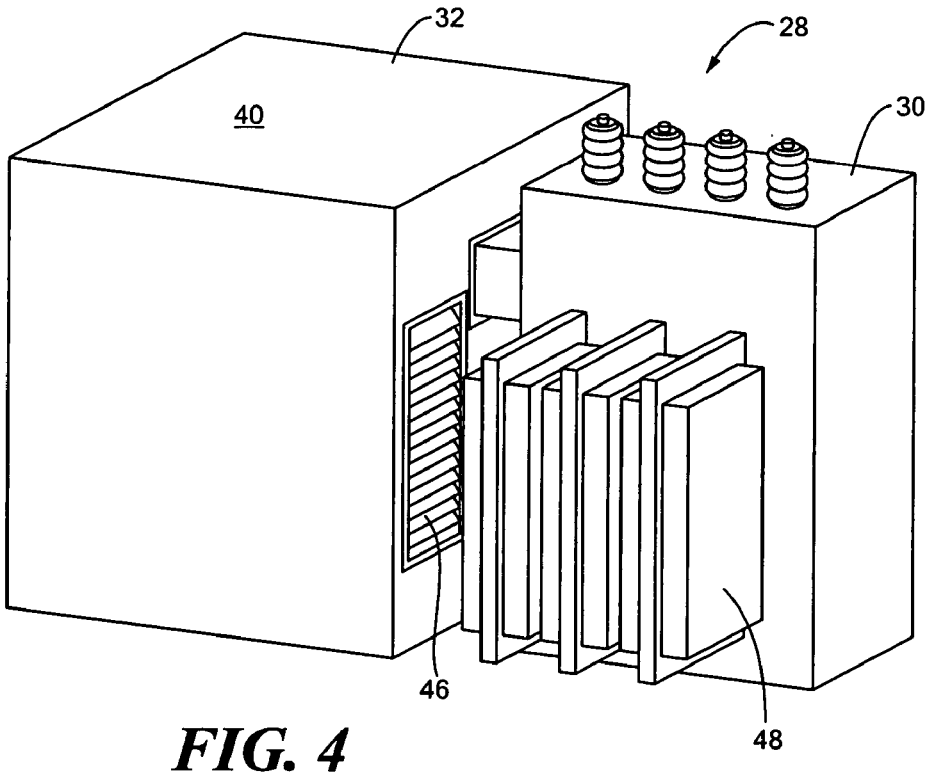
FIG. 4 is an alternative perspective view of the illustrative reactive power compensation system of FIG. 3.

FIG. 3 shows a perspective view of an illustrative reactive power compensation system 28, including a transformer 30 and a reactive power compensation device 32. FIG. 4 shows an alternative perspective view of the reactive power compensation system of FIG. 3. The illustrated reactive power compensation device 32 is the above-referenced PowerModule™ enclosure (PME) manufactured by American Superconductor Corporation and includes enclosure 40 having an air inlet 68. The enclosure 40 also has an air outlet 46 as shown in FIG. 4. The illustrative PME 32 is a metal enclosure on the order of 8 feet tall by 8 feet wide by 8 feet deep and generally is set off from a mounting pad by several inches.

In the illustrative embodiment, the air inlet 68 is a louvered inlet, here with fixed position louvers sized and spaced to prevent debris and/or animals from entering the enclosure. A bug screen may be provided on the inlet 68. Further in the illustrative embodiment, the air outlet 46 is an exhaust damper that opens in response to pressure. For example, the damper blades may be fully open in response to an airflow on the order of 1000 to 9000 CFM, and otherwise remains closed to prevent debris and/or animals from entering the enclosure. It will be appreciated by those of ordinary skill in the art that other types of enclosure form factors, air inlets, and air outlets are possible for the reactive power compensation device 32. For example, the air inlet 68 and outlet 46 may include solenoid or motor actuated louvers.

Figure 5:
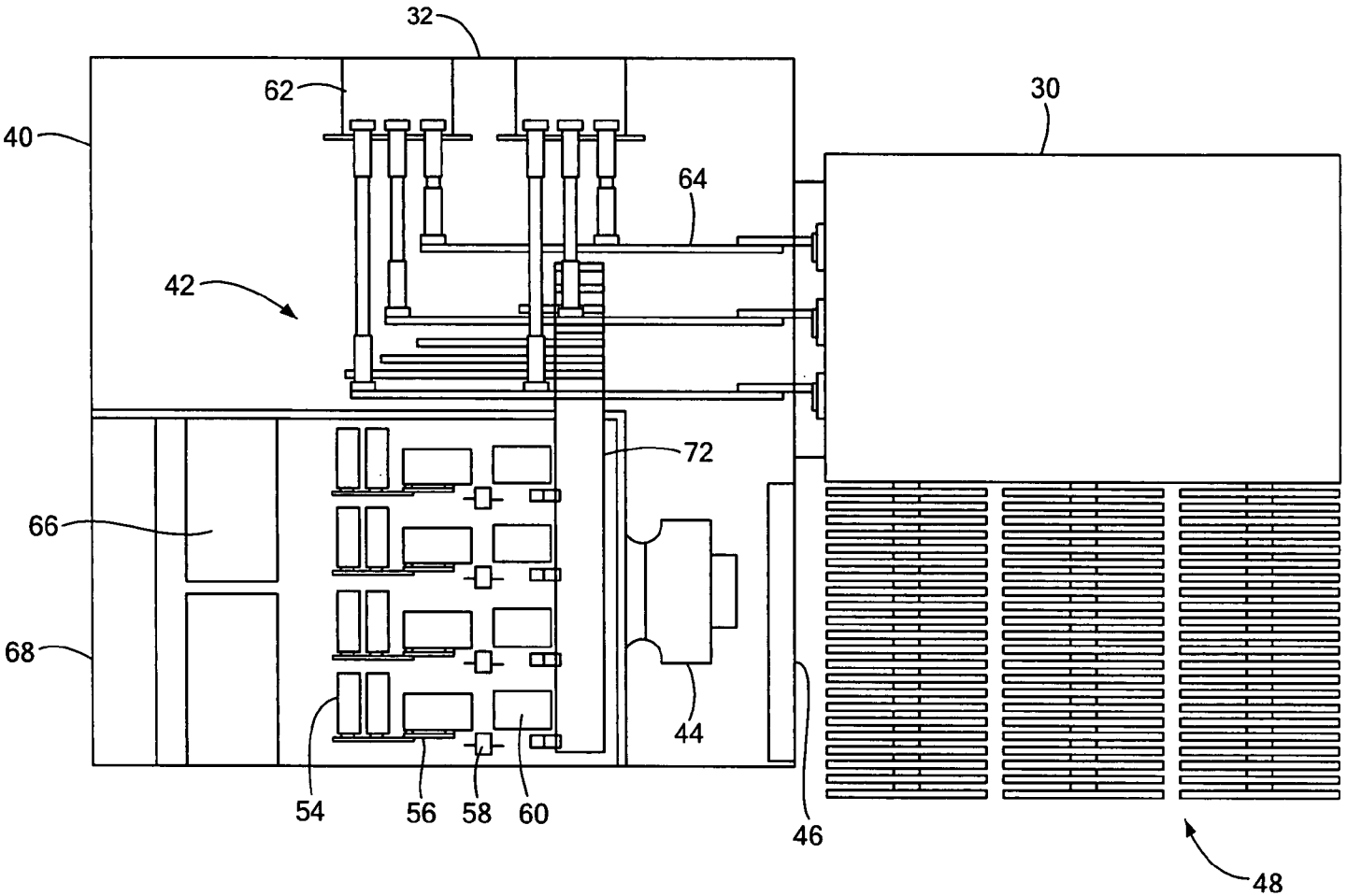
FIG. 5 is a partial cross-sectional top view of the reactive power compensation system of FIGS. 3 and 4.
Figure 6:
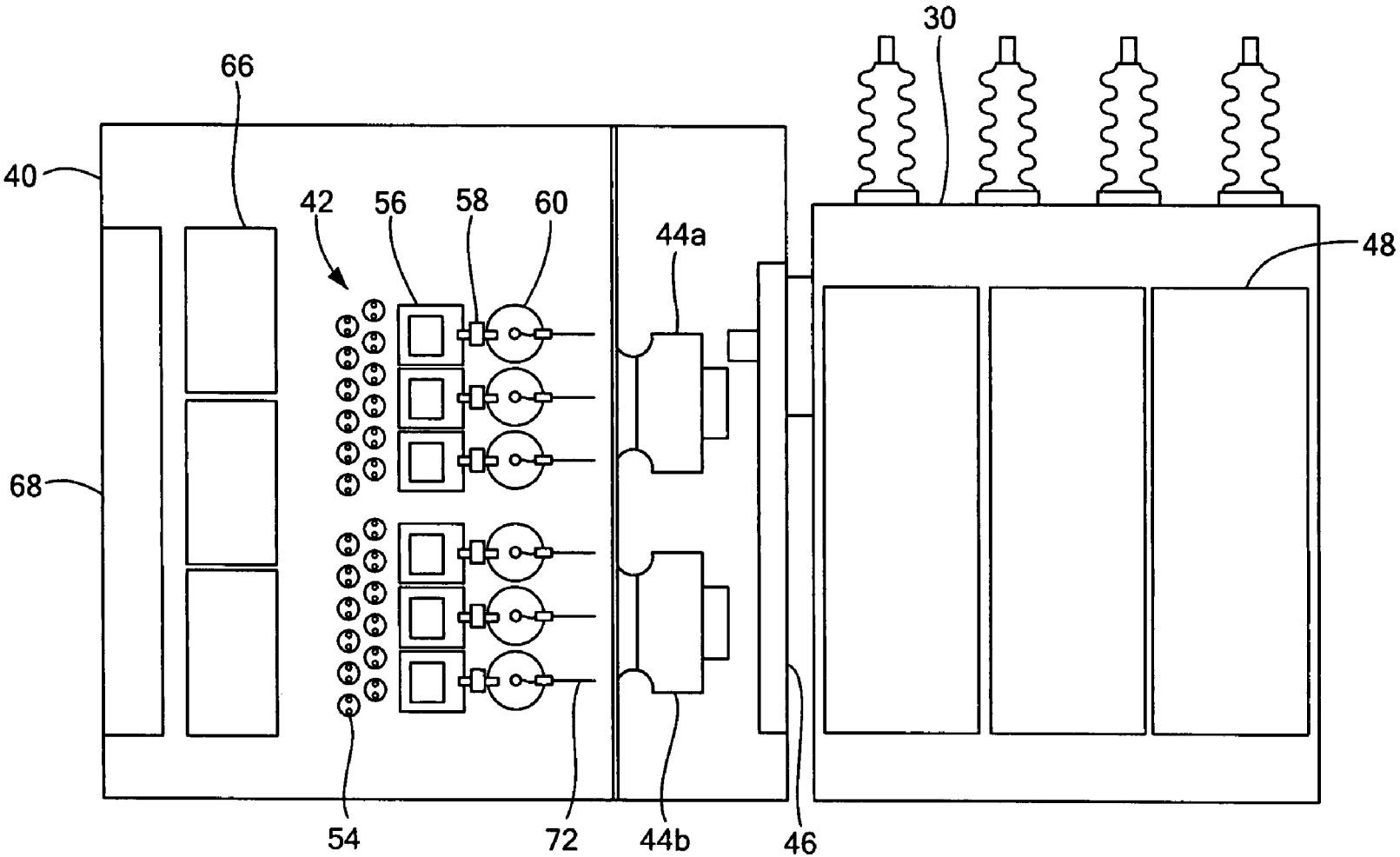
FIG. 6 is a partial cross-sectional side view of the reactive power compensation system of FIGS. 3 and 4.

FIG. 5 shows a partial cross-sectional top view of the reactive power compensation system 28 of FIGS. 3 and 4 and FIG. 6 shows a partial cross-sectional side view of the reactive power compensation system 28 of FIGS. 3 and 4.

Referring to FIGS. 3, 4, 5 and 6, the reactive power compensation device enclosure 40 contains power electronics 42 and at least one fan 44 which provides an airflow for cooling the power electronics. The enclosure 40 has an air inlet 68 through which air enters the enclosure and an air outlet 46, through which the airflow exits the enclosure after cooling the power electronics. The transformer 30 is electrically connected to the reactive power compensation device 32 and includes a cooling unit 48, such as the illustrated external cooling fins.

According to the invention, the air outlet 46 and the airflow from the reactive power compensation device 32 are directed toward the cooling unit 48 of the transformer 30 to provide supplementary cooling to the transformer. The airflow path will be shown and described further in connection with FIGS. 9 and 10. Preferably, the enclosure 40 is positioned between approximately 4 to 24 inches away from the transformer 30, depending on whether the low voltage connections to the transformer 30 are bolted to the bus bars internally or externally to the enclosure.

The illustrative transformer 30 is a liquid-filled transformer (sometimes referred to as a wet-type transformer), meaning that the transformer windings are submerged in a liquid with cooling and dielectric properties, such as oil, Freon or water. The transformer cooling unit 48 is provided by external cooling fins, that may be alternatively referred to as cooling radiators. Liquid filled secondary substation transformers such as transformer 30 typically have two power ratings; a self-cooled rating where natural convection of the air over the fins provide cooling, and a forced air rating which is typically on the order of 25% higher.

One suitable commercially available transformer 30 is the 210-15 transformer provided by Cooper Power Systems, Inc. of Waukesha, Wis., as noted above. When operated at its self-cooled rating of 4 MVA, the transformer fins 48 are expected to be at a temperature of approximately 40-60° C. above ambient.

In the illustrative embodiment, the fan 44 is provided by two individual fan units, or fans 44*a*, 44*b*, each providing approximately 4500 CFM, for a combined rating of 9000 CFM. One suitable fan is available from ebm-papst Inc. of Farmington, Conn. under part number R3G500-AG06-03. It will be appreciated by those of ordinary skill in the art however that various fans and fan arrangements are possible, including the use of a single fan or the use of more than two fans with varied cooling capabilities.

In operation, at lower power levels, the fan 44 is off. At the system's maximum rated power, the fan 44 is on to cool the power electronics 42. And at intermediate power levels, the fan speed is variable and controlled to provide the necessary amount of cooling based on ambient temperature, power electronics temperature, and desired VAR power level. In the preferred embodiment, a microprocessor-based controller within the reactive power compensation device 32 (not shown) sets an initial fan speed proportional to average VAR power level. The controller then monitors average IGBT heat sink temperature and regulates this temperature to a target temperature by means of a digital proportional-integral-derivative control loop which modifies the fan speed accordingly. The target temperature may be a fixed value or a function of ambient temperature. In particular, the controller controls the speed of the fan by communicating with a variable speed motor drive within the fan via an RS-485 serial communication link. It will be appreciated by those of ordinary skill in the art that many alternative approaches exist to implement variable speed cooling.

As is shown in the partial cross-sectional top view and side view of FIGS. 5 and 6, respectively, the power electronics 42 includes inverter DC link capacitors 54, inverter Insulated Gate Bipolar Transistor (IGBT) modules 56 including heat sinks, output fuses 58, filter inductors 60, circuit breakers 62, and output bus bars 64. In the illustrative embodiment, each of the IGBT modules 56 includes two IGBT devices. The enclosure 40 additionally contains air filters 66, as shown. A suitable air filter is manufactured by AAF International, of Louisville, Ky. as part number 3014883-016.

Figure 7:
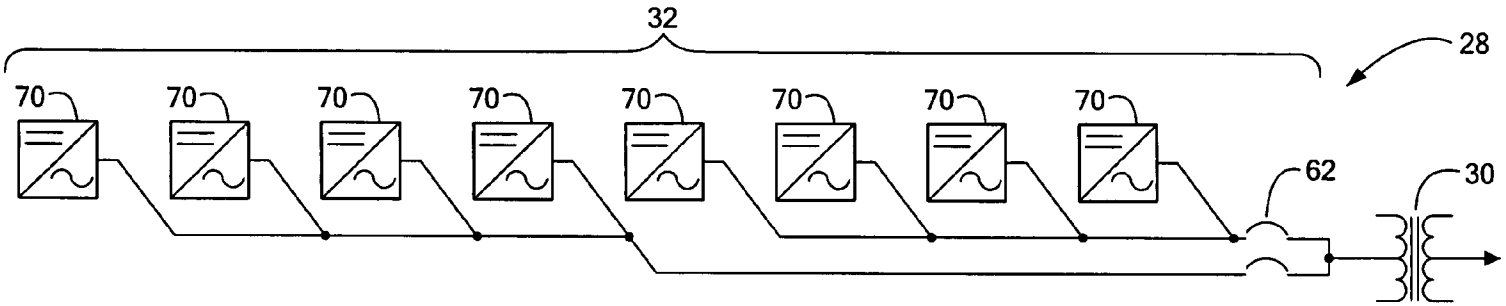
FIG. 7 is a simplified schematic of the reactive power compensation system of FIGS. 3 and 4.

Referring also to the schematic of FIG. 7, the reactive power compensation system 28 is shown to include the reactive power compensation device 32 and the transformer 30. The reactive power compensation device 32 includes a plurality of inverter circuits 70, each coupled in parallel with other inverter circuits and further coupled to circuit breakers 62, as shown. The circuit breakers 62 are further coupled to the transformer 30, as shown. In the illustrative embodiment, the reactive power compensation system 28 includes eight inverter circuits 70.

Figure 8:
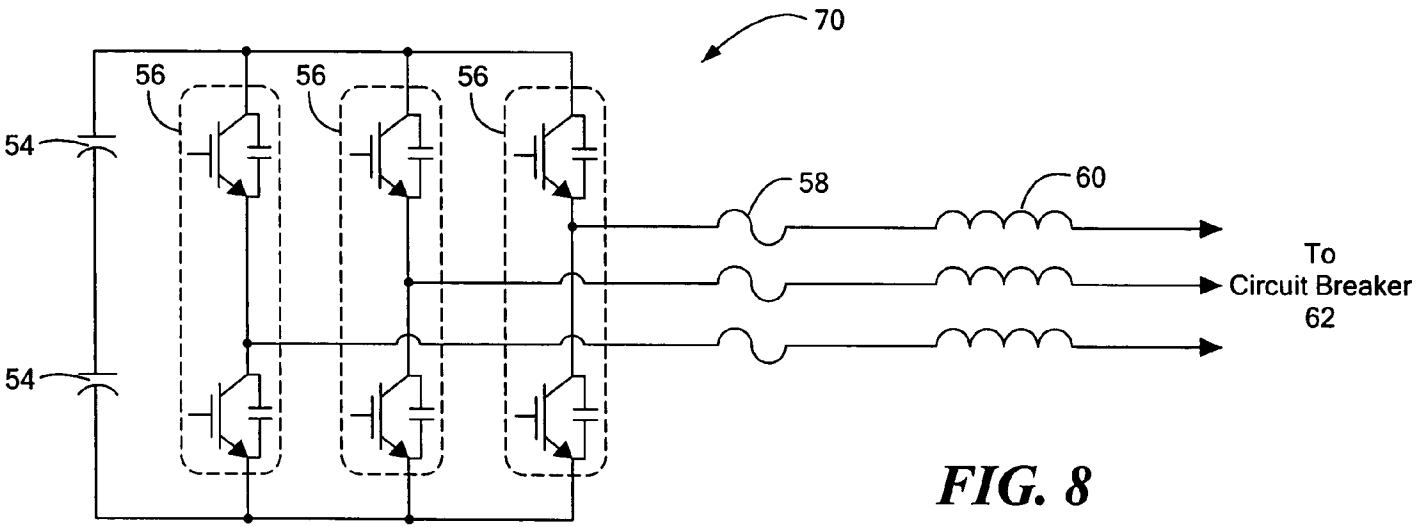
FIG. 8 is a simplified schematic of an illustrative inverter of FIG. 7.

Referring also to the schematic of FIG. 8, an illustrative inverter circuit 70 is shown to include three IGBT inverter modules 56, with each module servicing one phase of the three-phase power line. The interconnection between each inverter module pair is coupled to a respective output fuse 58 and filter inductor 60. As can be seen in the view of FIG. 5, the inductors 60 are coupled to the circuit breakers 62 by a bus bar arrangement 72. The circuit breakers 62 are further coupled to the transformer by bus bars 64, as shown. Also provided in the inverter circuit 70 are DC link capacitors 54, as shown. In the illustrative embodiment, each of the link capacitors is comprised of twelve electrolytic capacitors (FIGS. 5 and 6).

In operation, control circuitry (not shown) monitors the line voltage and, in response to the monitored line voltage, controls the IGBT modules 56 in order to generate the appropriate current waveforms for injection to the line in order to achieve the desired line voltage. The operation and control systems of some typical reactive power compensation systems according to this invention are described in the following U.S. Patents: U.S. Pat. Nos. 6,392,856; 6,987,331; and 6,906,434.

Figure 9:
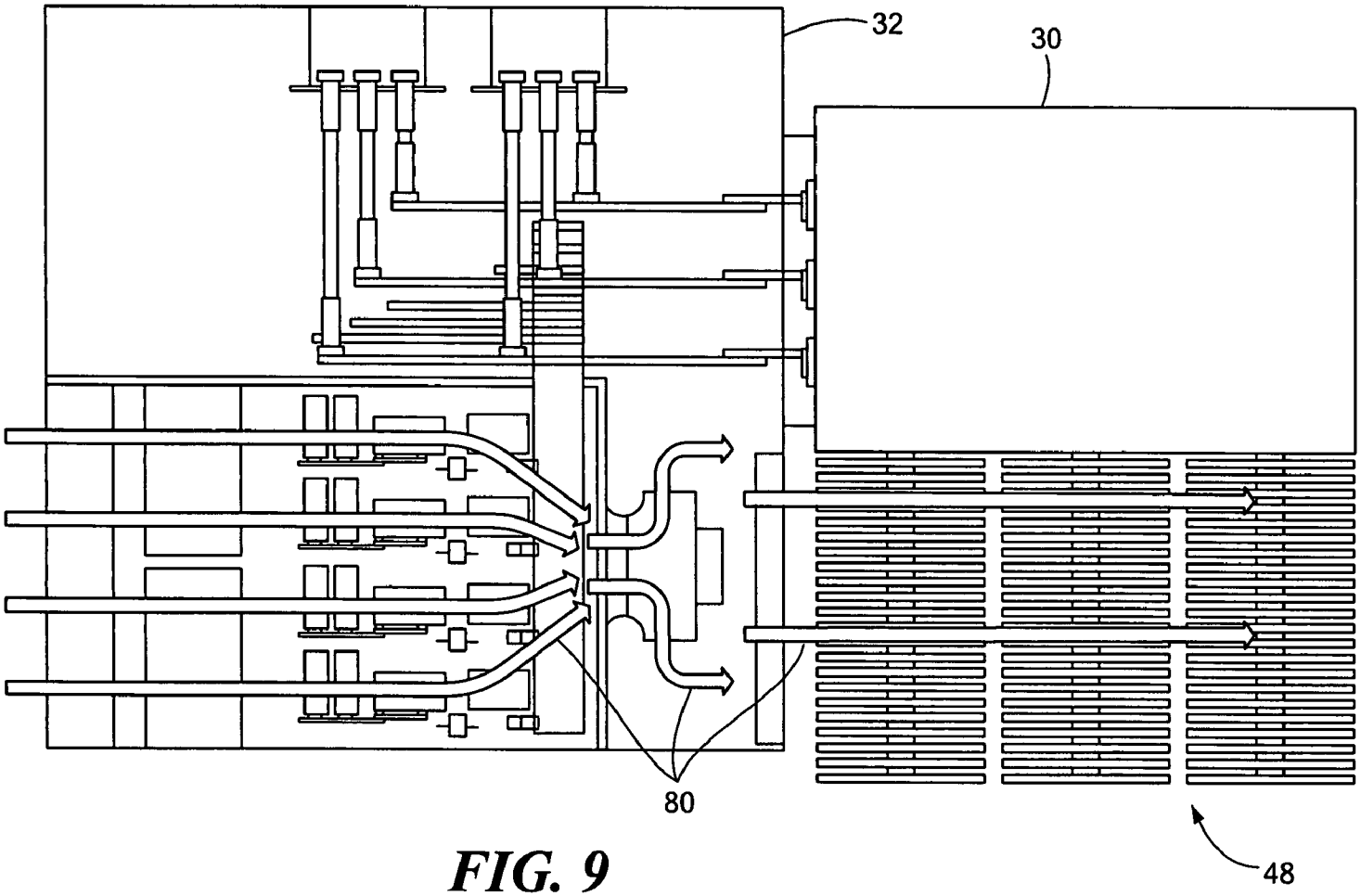
FIG. 9 shows the partial cross-sectional top view of FIG. 5 including arrows illustrating airflow.
Figure 10:
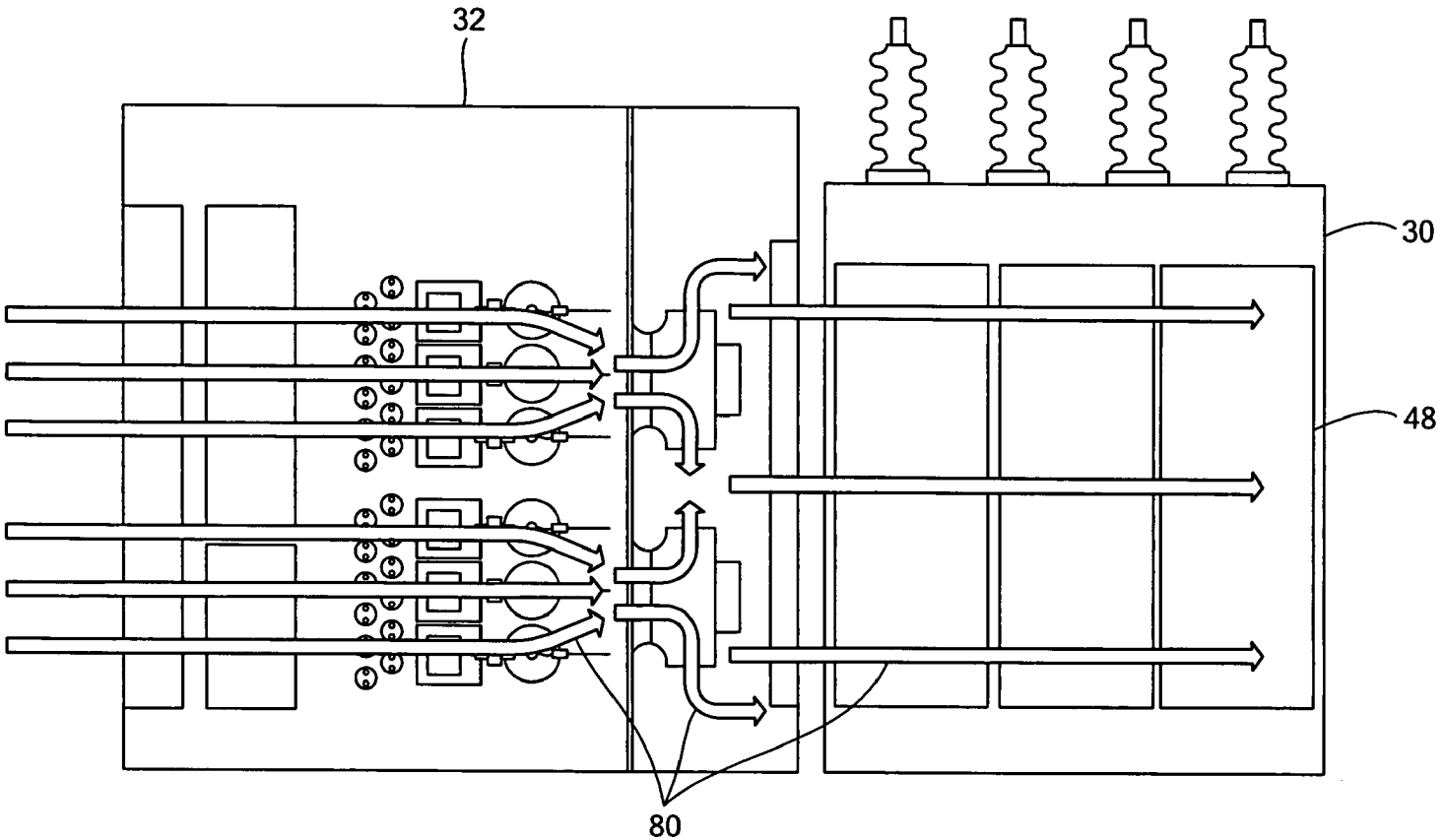
FIG. 10 shows the partial cross-sectional side view of FIG. 6 including arrows illustrating airflow.

Referring also to FIGS. 9 and 10, the partial cross-sectional views of FIGS. 5 and 6, respectively, are shown to include arrows 80 illustrating airflow paths through the reactive power compensation device 32 and across the transformer cooling unit 48. As is apparent, the fan 44 draws an airflow 80 through the inlet 68 and into the enclosure 40. The airflow 80 moves across the power electronics 42 to cool the power electronics and travels through the fan 44 and the air outlet 46, towards and across the transformer cooling fins 48, as shown.

The temperature rise of the airflow through the enclosure 40 is expected to be on the order of 101C. Thus, given an ambient air temperature on the order of 50° C., the airflow exiting the enclosure 40 may be on the order of 60° C. While this air is hotter than ambient, it is still able to provide supplemental cooling to the transformer since, as noted above, the illustrative transformer fins 48 are expected to be a temperature of approximately 40-60° C. above ambient when the transformer is operated at 4 MVA. Thus, the 60° C. airflow from the enclosure 40 augments the cooling of the 90-110° C. fins 48 as compared to relying solely on natural convection to cool the fins. With this arrangement, the natural convection cooling of the fins 48 operates normally at lower power levels when the fan 44 is off. At the system's maximum rated power, when the fan 44 is required to be on to cool the power electronics 42, the transformer 30 receives supplementary cooling from the air exiting the air outlet 46 and at intermediate power levels, the fan speed is variable and controlled to provide the necessary amount of cooling based on ambient temperature. The secondary, or supplemental cooling provided by the airflow from the enclosure 40 permits the transformer to be used at a higher power than otherwise possible and/or at the same power rating, but without further supplemental cooling (i.e., additional fans), while also permitting the enclosure 40 to be located close to the transformer 30, as is desirable.

Figure 11:
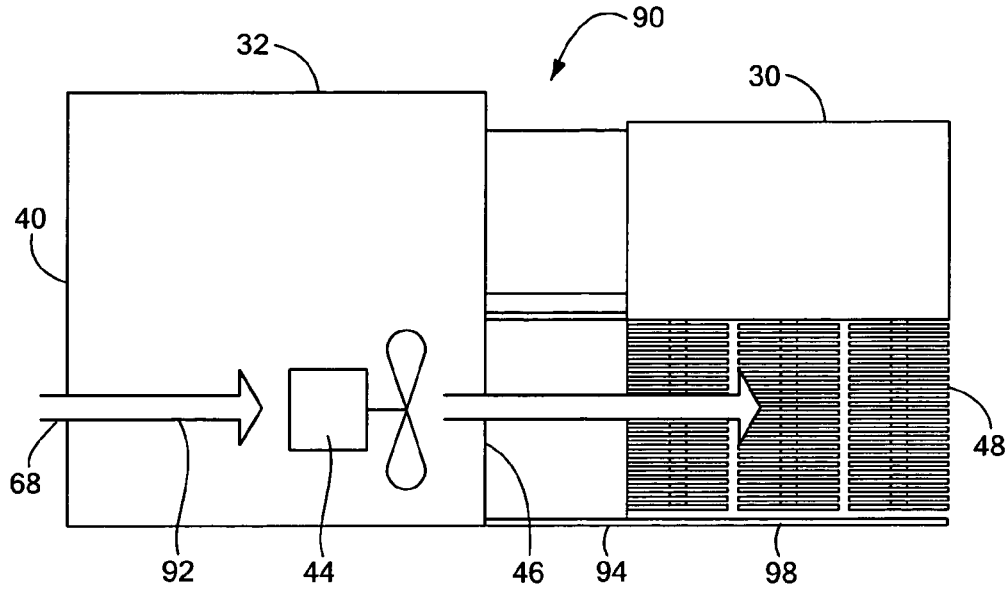
FIG. 11 is a top view of an alternate reactive power compensation system of the invention including a duct and a duct extension.
Figure 12:
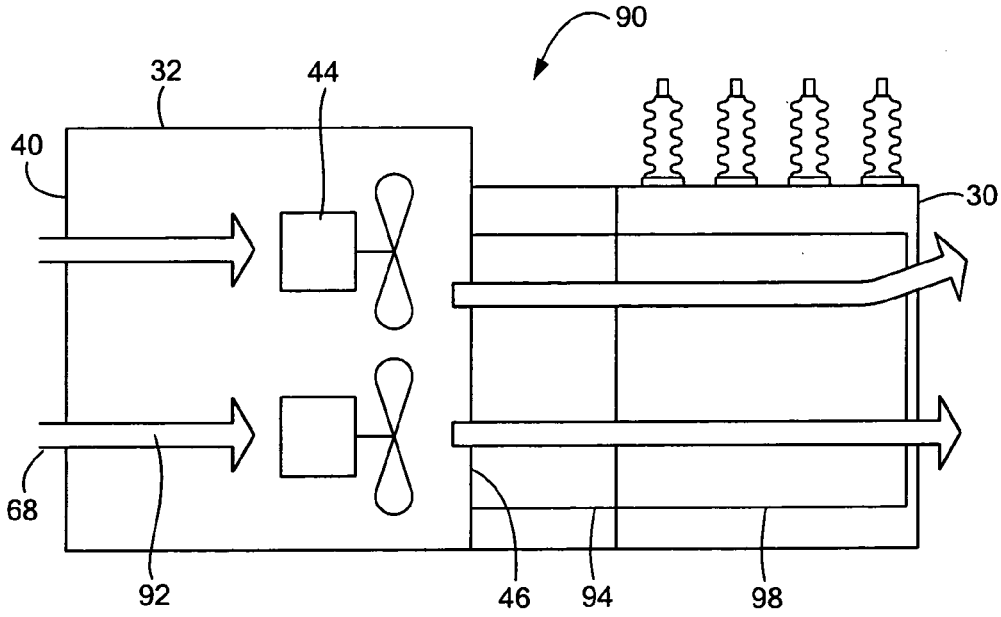
FIG. 12 is a side view of the reactive power compensation system of FIG. 11.

Referring to the top view of FIG. 11 and the side view of FIG. 12, in which like reference numbers refer to like components, an alternate reactive power compensation system 90 includes the reactive power compensation device 32 and the transformer 30, each having features as numbered and as described above.

The reactive power compensation system 90 differs from system 28 of FIGS. 3-6 in that system 90 additionally includes a duct 94, as shown. The duct, which may be referred to alternatively as a shroud or sleeve, enhances the supplemental cooling provided to the transformer 30 by better directing the airflow from the reactive power compensation device 32 to the transformer cooling unit 48. In particular, the duct 94 prevents the airflow from the reactive power compensation device 32 from disbursing as it is directed from the enclosure 40 to the transformer fins 48.

The duct 94 is positioned between the enclosure 40 and the transformer cooling unit 48 and, in the illustrated embodiment, is substantially enclosed. More particularly, the illustrated duct has a substantially square cross-section and is enclosed on all four sides. The duct may be comprised of various suitable materials, such as the same metal as the enclosure 40. Furthermore, the duct may be manufactured as part of the enclosure 40, as part of the transformer 30, or preferably as a separate structure that may be attached to the enclosure and/or the transformer by a suitable mechanism.

The duct 94 may have an extension 98 that is adjacent to a portion of the transformer cooling unit 48, in order to still further facilitate directing the airflow across the transformer fins. In the illustrative embodiment, the extension 98 extends along one side of the transformer cooling fins, thereby leaving the top of the fins exposed, as shown. It will be appreciated by those of ordinary skill in the art that various other form factors for the duct extension are possible. For example, in some systems it may be desirable to have the duct extension extend along two sides of the transformer cooling fins and/or extend along only a portion of one or more sides of the cooling fins.

In use, an airflow illustrated by arrows 92 enters the enclosure 40 of the reactive power compensation device 32 through the air inlet 68, flows across power electronics in the enclosure, and exits the enclosure through the air outlet 46. The airflow 92 then flows through the duct 94 and across the transformer cooling fins 48 as further directed by the duct extension 98, as shown.

Regardless of the particular form factor, it is desirable to design the duct extension 98 so that at least a portion of the transformer cooling fins 48 remains exposed to ambient conditions. With this arrangement, the duct extension 98 serves to further direct the airflow from the enclosure 40 over the cooling fins, while also permitting natural convection cooling of the fins by leaving a portion of the cooling fins exposed above and below the extension 98.

The duct 94 provides the additional advantage of reducing the ambient noise level associated with the fan 44. This is because the duct 94 confines some of the fan noise to a single axis with the airflow 92.

Figure 13:
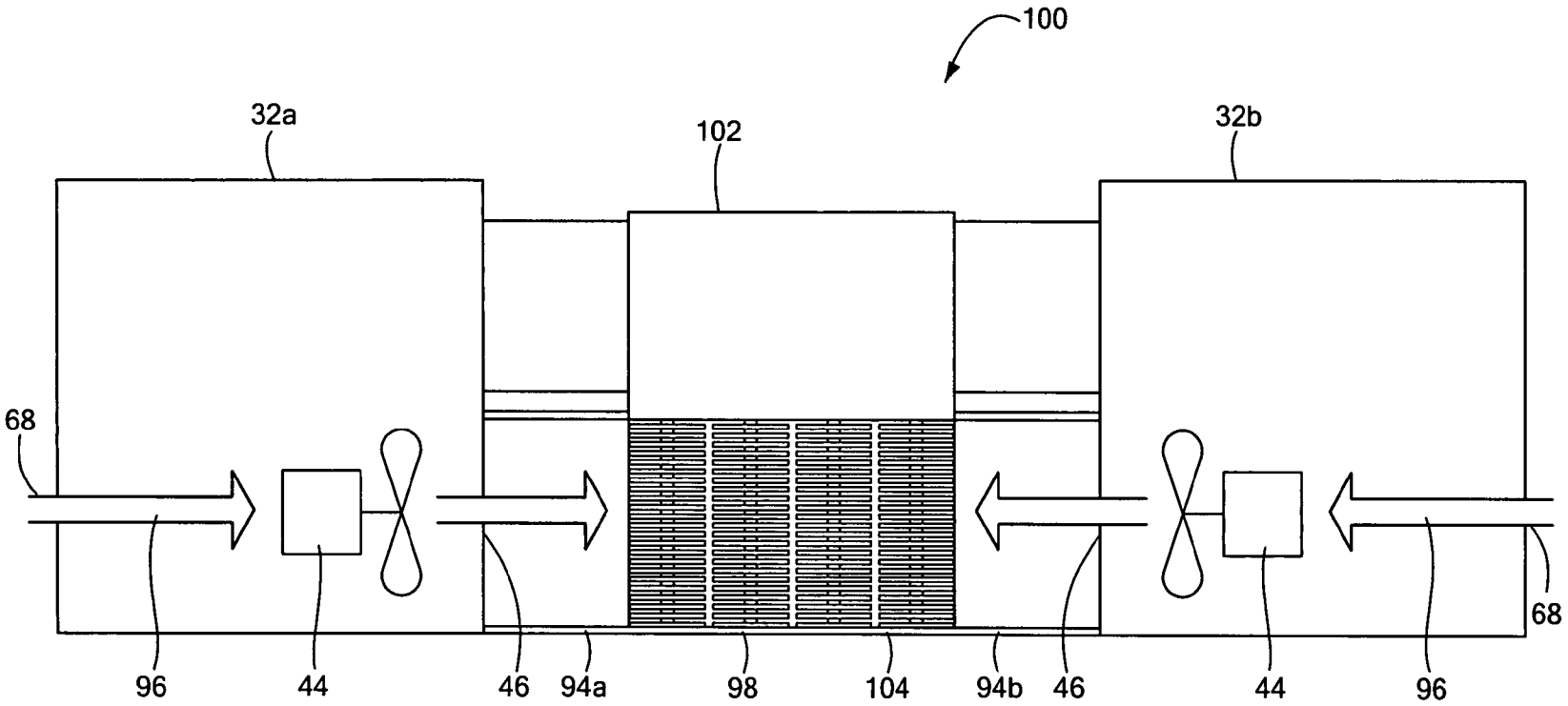
FIG. 13 is a top view of a further alternate reactive power compensation system of the invention including a duct, and a duct extension, and two reactive power compensation devices.
Figure 14:
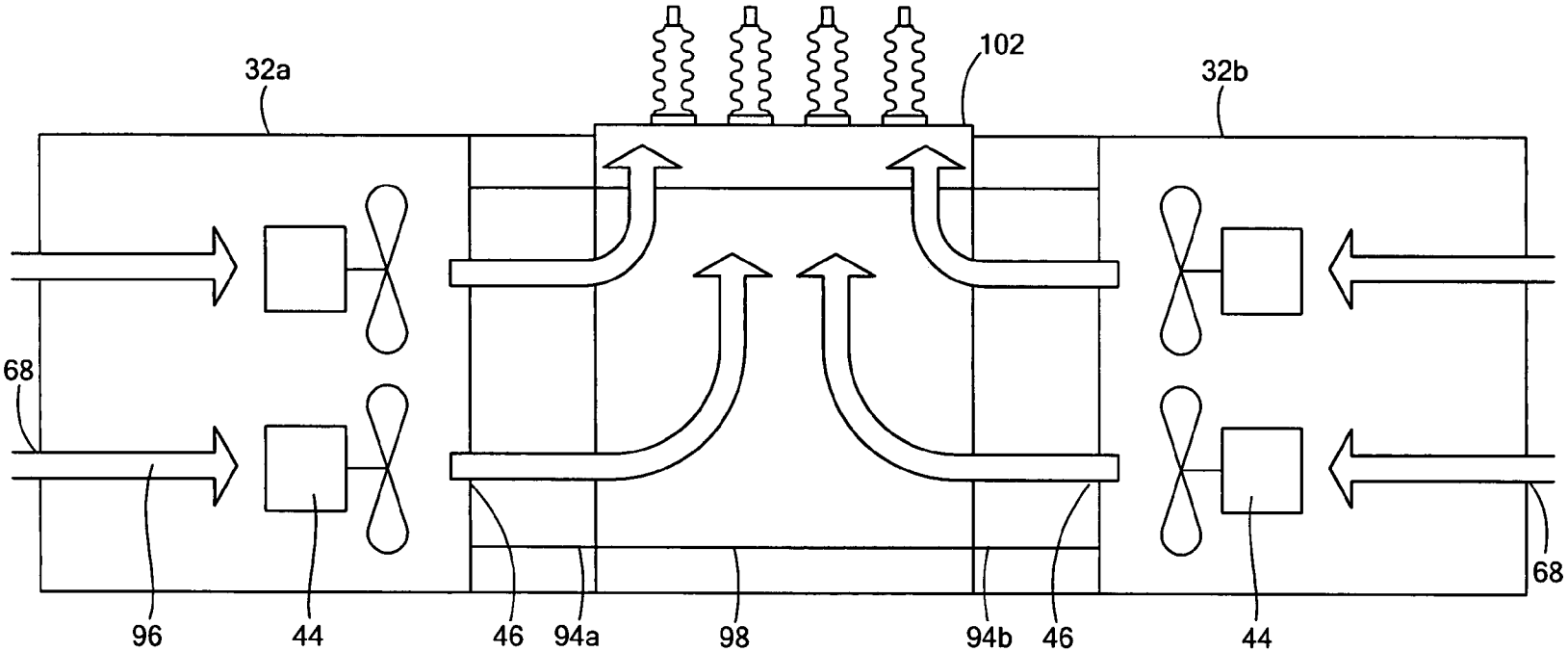
FIG. 14 is a side view of the reactive power compensation system of FIG. 13.

Referring also to the top view of FIG. 13 and the side view of FIG. 14, in which like reference numbers refer to like components, an alternate reactive power compensation system 100 includes two reactive power compensation devices 32*a*, 32*b* and a transformer 102. More particularly, each reactive power compensation device 32*a*, 32*b* is substantially identical to device 32 of FIGS. 3-6. The reactive power compensation system 100 differs from system 28 of FIGS. 3-6 in that it is an 8 MVA system and thus, utilizes two reactive power compensation devices 32*a*, 32*b*. Thus, the transformer 102 differs from the transformer 30 in that transformer 102 is rated for 8 MVA operation and has two low-voltage windings, one connected to each reactive power compensation device 32*a*, 32*b*. Transformer 102 is a liquid-filled transformer having a cooling unit 104 provided by external cooling fins. Suitable transformers of this type are the 210-15 substation transformers available from Cooper Power Systems, Inc. of Waukesha, Wis.

The reactive power compensation system 100 further includes two ducts 94*a*, 94*b*, each substantially identical to the duct 94 of FIGS. 11 and 12. A first duct 94*a* is positioned between the reactive power compensation device 32*a* and a first side of the transformer 102 and a second duct 94*b* is positioned between the reactive power compensation device 32*b* and a second side of the transformer 102, as shown. Also provided is a duct extension 98 disposed adjacent to a side of the transformer cooling unit 104, as shown. With this illustrated arrangement, the transformer cooling fins 104 are exposed to ambient conditions from a top surface as is apparent from the top view of FIG. 13, and as is desirable to permit natural convection cooling of the fins.

In operation, an airflow illustrated by arrows 96 enters each of the enclosures 40 of the reactive power compensation devices 32*a*, 32*b*, flows across power electronics in the respective enclosures and exits the enclosures through the respective air outlet 46. The airflow 96 flows through the respective duct 94*a*, 94*b*, across the transformer cooling fins 48, and exits the system at the top of the fins as is apparent from FIG. 14.

As before, the ducts 94*a* and 94*b* provide the additional advantage of reducing the ambient noise level associated with the fans 44. Here the ducts 94*a* and 94*b* not only confine some of the fan noise to the axis of airflow 96 but causes it to radiate upward with the airflow as it passes across the transformer cooling fins 48, and exits the system at the top of the fins as is apparent from FIG. 14.

Figure 15:
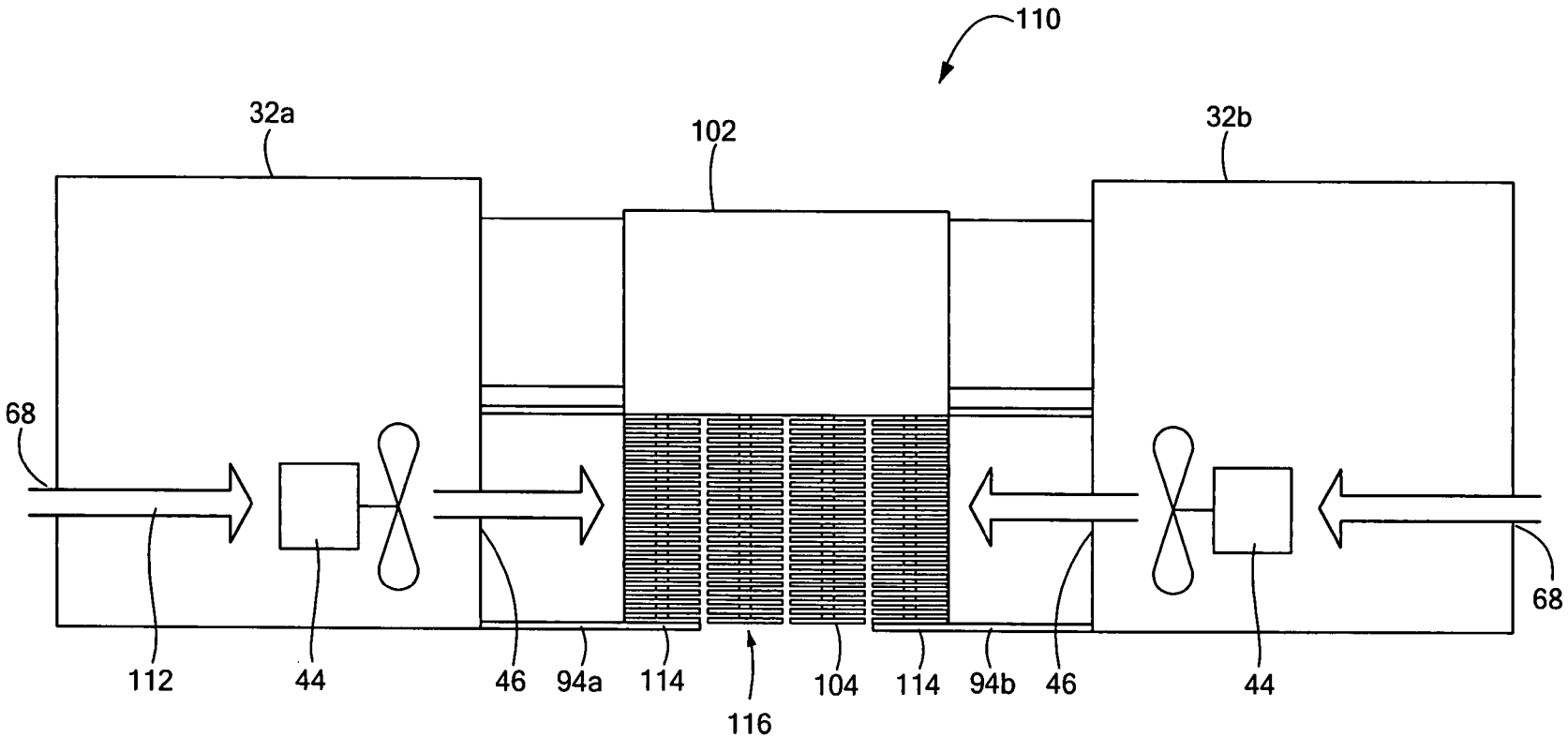
FIG. 15 is a top view of still another alternate reactive power compensation system of the invention including a duct, a duct extension and two reactive power compensation devices.

Referring also to the top view of FIG. 15, in which like reference numbers refer to like components, a further alternate reactive power compensation system 110 includes two reactive power compensation devices 32*a*, 32*b* and a transformer 102, each having features as numbered and as described above. More particularly, each reactive power compensation device 32*a*, 32*b* is substantially identical to device 32 of FIGS. 3-6. Like the reactive power compensation system 100 of FIGS. 13 and 14, the system 110 is an 8 MVA system and thus, utilizes two reactive power compensation devices 32*a*, 32*b* and an 8 MVA rated transformer 102. Also, like the system 100 of FIGS. 13 and 14, the reactive power compensation system 110 includes two ducts 94*a*, 94*b*, each substantially identical to the duct 94 of FIGS. 11 and 12. A first duct 94*a* is positioned between the reactive power compensation device 32*a* and a first side of the transformer 102 and a second duct 94*b* is positioned between the reactive power compensation device 32*b* and a second side of the transformer 102, as shown.

A duct extension 114 is disposed adjacent to a portion of the transformer cooling unit 104, as shown. Like the duct extension 98 of FIGS. 13 and 14, the duct extension 114 facilitates directing the airflow 112 from the two reactive power compensation devices 32*a*, 32*b* to the transformer cooling unit 104, thereby enhancing the supplemental cooling provided to the transformer.

The duct extension 114 differs from the duct extension 98 of FIGS. 13 and 14 in that an opening 116 is provided in the extension 114. The opening 116 enhances the natural convection cooling of the fins 104, as may be desirable in certain applications or situations such as when the system is idling and there is no airflow from the reactive power compensation devices 32*a*, 32*b*. Since the transformer 102 still has idling losses that produce heat, the limited natural convection provided by the opening 116 will provide more than adequate cooling for the transformer.

Figure 16:
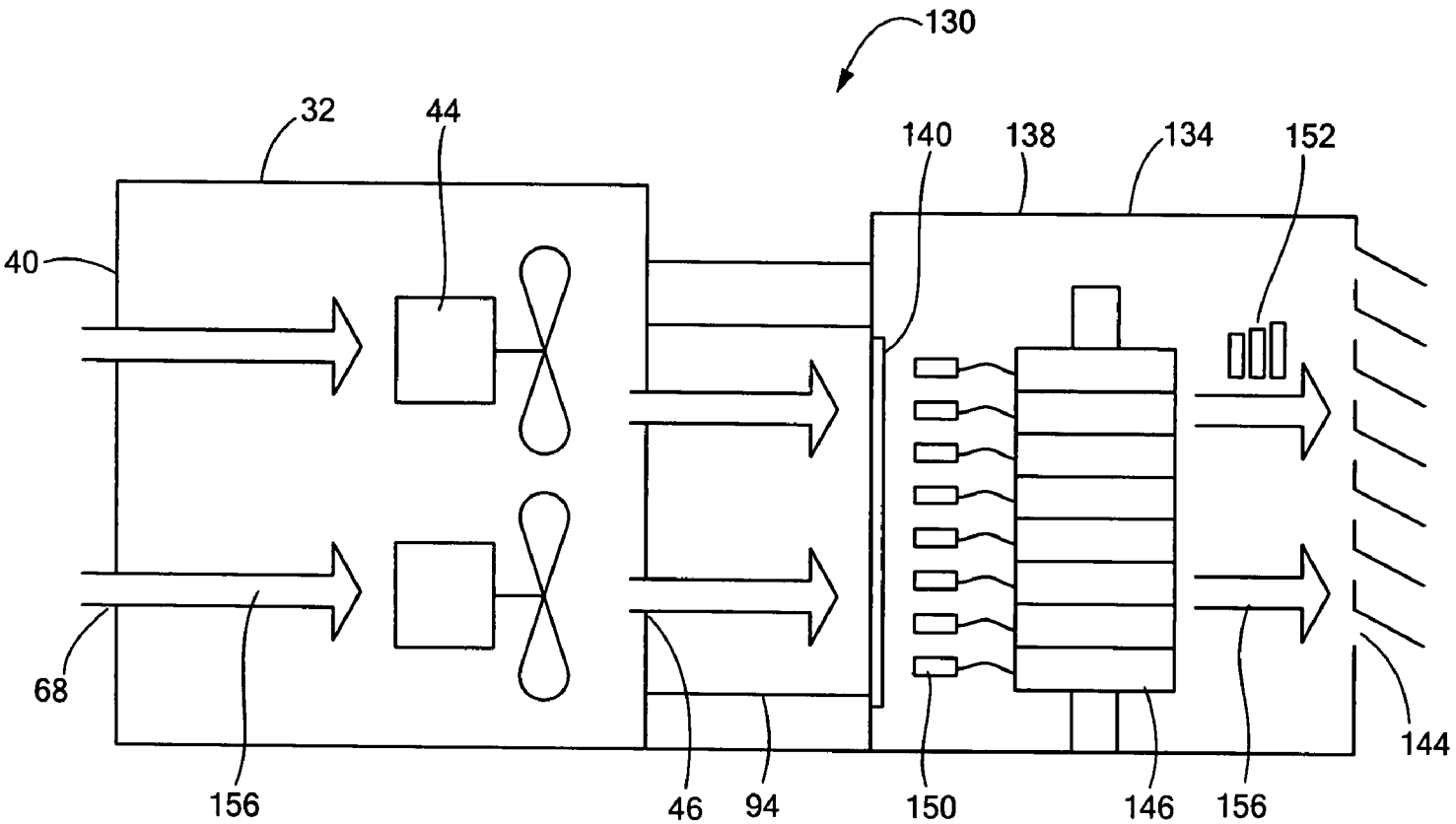
FIG. 16 is a partial cross-sectional side view of an alternate reactive power compensation system including a dry-type transformer.

Referring to FIG. 16, in which like reference numbers refer to like components, an alternate reactive power compensation system 130 includes a reactive power compensation device 32 and a transformer 134. The reactive power compensation device 32 is substantially identical to device 32 of FIGS. 3-6. The reactive power compensation system 130 differs from system 28 of FIGS. 3-6 in that the transformer 134 is a dry-type transformer.

The transformer 134 includes a housing 138 having an air inlet 140, such as may include louvers and/or a bug screen, and an air outlet 144, such as may be provided by fixed position louvers, as shown. Also shown in the view of FIG. 16 are the transformer windings 146, the inverter bus bar connection points 150 (i.e., connection points for connecting to the device 32) and the medium voltage bus 152 provided across the transformer secondary winding. By dry-type transformer, it is meant that the transformer windings 146 are not submerged in a liquid, as is the case with liquid-filled transformers. Rather, the transformer windings 146 are cooled by natural convection from airflow passing through the housing 138. Thus, the air inlet 140 of the transformer housing 138 can be characterized as the cooling unit of the dry-type transformer 134. One suitable transformer 138 of this type is manufactured by Hammond Power Solutions Inc. of Baraboo, Wis. under catalog no. HPWR-04.

According to the invention, the air outlet 46 and the airflow from the reactive power compensation device 32 are directed toward the cooling unit, here the air inlet 140, of the transformer 134 to provide supplementary cooling to the transformer by directing the airflow (here illustrated by arrows 156) from the reactive power compensation device towards and into the transformer housing inlet. The airflow 156 exits the transformer housing through the air outlet 144.

Here again, the temperature rise of the airflow through the enclosure 40 is expected to be on the order of 10° C. Thus, given an ambient air temperature on the order of 50° C., the airflow exiting the enclosure 40 may be on the order of 60° C. While this air is hotter than ambient, it is still able to provide supplemental cooling to the transformer 134 since, the illustrative transformer windings are expected to be a temperature of approximately 150° C. above ambient when the transformer is operated at 4 MVA. Thus, the airflow from the enclosure 40 augments the cooling of the transformer windings 146 as compared to relying solely on natural convection to cool the windings.

The reactive power compensation system 130 of FIG. 16 includes a duct 94 in order to facilitate directing the airflow 156 from the reactive power compensation device 32 to the transformer housing air inlet 140 by preventing the airflow from dispersing.

All references cited herein are hereby incorporated herein by reference in their entirety.

Having described preferred embodiments of the invention, it will now become apparent to one of ordinary skill in the art that other embodiments incorporating their concepts may be used.

For example, it will be appreciated by those of ordinary skill in the art that the particular arrangement of the power electronic components housed in the enclosure 40 is illustrative only and may be readily varied without departing from the invention. It will also be appreciated that the form factor (e.g., size and shape) of various components of the illustrated reactive power compensation systems (e.g., the reactive power compensation device enclosure, the air inlet, the air outlet, the transformer and transformer cooling unit, the duct, and the duct extension) may be readily varied to optimize certain system requirements such as output power, footprint, etc. without departing from the invention.

It is felt therefore that these embodiments should not be limited to disclosed embodiments, but rather should be limited only by the spirit and scope of the appended claims.

What is claimed is:

1. A reactive power compensation system coupled to a utility network to provide reactive power, comprising:

a reactive power compensation device having an enclosure housing power electronics and at least one fan which provides an airflow for cooling the power electronics, the enclosure having an air outlet through which the airflow exits the enclosure after providing cooling to the power electronics; and a transformer electrically connected to the reactive power compensation device and having a cooling unit, wherein the air outlet and airflow from the reactive power compensation device are directed toward the cooling unit of the transformer to provide supplementary cooling to the transformer.

2. The reactive power compensation system of claim 1 wherein the reactive power compensation system is adapted to inject or withdraw real or reactive power from the utility network to restore a line voltage to a desired level.

3. The reactive power compensation system of claim 1 wherein the reactive power compensation system is adapted to be coupled in parallel or in series with the utility network.

4. The reactive power compensation system of claim 1 wherein the reactive power compensation system is adapted to be coupled to the utility network and in proximity to at least one of: a power system substation, a customer site, or a wind farm.

5. The reactive power compensation system of claim 1 wherein the cooling unit of the transformer includes external cooling fins and the airflow from the reactive power compensation device is directed over the cooling fins.

6. The reactive power compensation system of claim 5 wherein the transformer is a liquid-filled transformer.

7. The reactive power compensation system of claim 1 further comprising a duct disposed between the air outlet of the enclosure and the cooling unit of the transformer, wherein the airflow from the reactive power compensation device is directed through the duct to the cooling unit of the transformer.

8. The reactive power compensation system of claim 7 wherein the duct is substantially enclosed.

9. The reactive power compensation system of claim 7 wherein the cooling unit of the transformer includes external cooling fins and wherein the duct has an extension adjacent to cooling fins of the transformer, wherein a portion of the cooling fins is exposed.

10. The reactive power compensation system of claim 1 wherein the cooling unit of the transformer includes an air inlet of the transformer which is directed to windings of the transformer and wherein the airflow from the reactive power compensation device is directed to the air inlet.

11. The reactive power compensation system of claim 10 wherein the transformer is a dry-type transformer.

12. The reactive power compensation system of claim 1 wherein the enclosure is positioned less than approximately two feet away from the transformer.

13. A method of cooling a transformer of a reactive power compensation system comprising a reactive power compensation device having an enclosure housing power electronics and a fan which provides an airflow for cooling the power electronics, the system further comprising a transformer electrically connected to the reactive power compensation device and having a cooling unit, the method comprising:

directing the airflow from the reactive power compensation device to the cooling unit of the transformer to provide supplementary cooling to the transformer.

14. The method of claim 13 wherein the enclosure has an air outlet through which the airflow exits the enclosure after providing cooling to the power electronics and wherein directing comprises positioning the air outlet of the enclosure in close proximity to the cooling unit of the transformer.

15. The method of claim 14 wherein the enclosure is positioned less than approximately two feet away from the transformer.

16. The method of claim 13 wherein the transformer is a liquid-filled transformer and the cooling unit of the transformer comprises external cooling fins.

17. The method of claim 13 wherein the transformer is a dry-type transformer and the cooling unit of the transformer comprises an air inlet of the transformer directed to windings of the transformer.

18. The method of claim 14 wherein directing further comprises providing a duct between the air outlet of the enclosure and the cooling unit of the transformer.

19. The method of claim 18 wherein the duct is substantially enclosed.

20. The method of claim 19 wherein the cooling unit of the transformer includes external cooling fins and wherein the method further comprises providing a duct extension adjacent to the cooling fins.

21. The method of claim 20 wherein the duct extension is at least partially open to expose at least a portion of the cooling fans.

* * * * *